US007077589B2

(12) United States Patent
Fujibayashi et al.

(10) Patent No.: US 7,077,589 B2
(45) Date of Patent: Jul. 18, 2006

(54) IMAGE FORMING APPARATUS

(75) Inventors: Mitsuyuki Fujibayashi, Tokyo (JP); Shoji Kikuchi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/876,353

(22) Filed: Jun. 23, 2004

(65) Prior Publication Data

US 2004/0265028 A1 Dec. 30, 2004

(30) Foreign Application Priority Data

Jun. 30, 2003 (JP) ..... 2003-186872

(51) Int. Cl.
*B65H 1/00* (2006.01)

(52) U.S. Cl. ..... 400/624; 400/76; 399/365; 399/367; 358/296; 271/153

(58) Field of Classification Search ..... 400/624–629, 400/76; 399/363, 365, 367, 393; 358/296, 358/497; 271/153
See application file for complete search history.

(56) References Cited

U.S. PATENT DOCUMENTS 5,347,350 A * 9/1994 Nakahata et al. ..... 399/23
5,727,890 A * 3/1998 Stodder et al. ..... 400/624
6,017,161 A * 1/2000 Harris et al. ..... 400/625
6,163,659 A * 12/2000 Chen ..... 399/17
6,824,133 B1 * 11/2004 Richtsmeier ..... 271/153
6,929,414 B1 * 8/2005 Kadomatsu ..... 400/608.2
2005/0201787 A1 * 9/2005 Nakamura ..... 399/367

FOREIGN PATENT DOCUMENTS

JP 02-056375 A 2/1990
JP 02-138805 A 5/1990
JP 06-056313 A 3/1994
JP 10-198174 A 7/1998

* cited by examiner

*Primary Examiner*—Andrew H. Hirshfeld
*Assistant Examiner*—Dave A. Ghatt
(74) *Attorney, Agent, or Firm*—Canon U.S.A. Inc IP Division

(57) ABSTRACT

Recording medium feeding means includes a recording medium determination device, in which an arm biased by a spring toward recording medium loading means is rotatably attached to a lever rotated by a rotatably driven cam member, two holder segments are rockingly attached to the arm, and a recording medium detector held by one of the holder segments reads information, such as the type and properties, on the recording media. A cam element is provided between the cam member and the lever for gradually rotating the lever.

14 Claims, 13 Drawing Sheets

IMAGE FORMING APPARATUS

BACKGROUND OF THE INVENTION

1. Field of the Invention

The present invention relates to image forming apparatuses such as copiers, facsimiles, and printers, and particularly to an image forming apparatus having a recording medium determination device.

2. Description of the Related Art

Image forming apparatuses such as copiers, facsimiles, printers, and printing equipment have been widely used for recording, based on image information, onto recording media such as recording paper. In response to market demands and technical advances made in image forming apparatuses (recording equipment), a variety of recording media have been developed and put into practical use these days. Examples of such recording media include thin paper such as recording paper coated with an ink-absorbing layer to achieve improved image quality, heavy paper such as postcards, plastic sheets, and printable fabric. Typical image forming apparatuses (recording apparatuses), among those capable of recording onto such a variety of recording media, are inkjet printers that form images by spraying ink through nozzles.

Since ink placed on recording media exhibits different degrees of blurring and brightness of colors depending on the type of media, the amount of ink and the number of ink dots are determined based on the type of recording media to achieve the best image quality. They are normally determined by the user's selection of the type of media through the use of setting functions in host computers or printers. An increase in the number of types of recording media leads to an increase in options of the user's selection, and thus adds complexity to the operation. Moreover, since printers do not give warnings in response to the erroneous selection by the user, the use of paper capable of producing high quality images may produce images with low quality.

Additionally, if a printer, such as a network printer shared by a plurality of users, is located remote from a user, the user needs to go to the printer to check the types of recording media held in recording medium storage unit in order to subsequently select the type of recording media to be used for printing. To eliminate such inefficiency and solve the other problems described above, a variety of determination devices for detecting the type of recording media are proposed in, for example, Japanese Patent Laid-Open No. 2-138805, Japanese Patent Laid-Open No. 10-198174, Japanese Patent Laid-Open No. 2-56375, and Japanese Patent Laid-Open No. 6-56313.

However, each of the determination devices disclosed in these patents documents requires a carrier for conveying recording media to maintain a certain distance between a recording medium detector and the recording media, thereby causing an increase in the size of the entire apparatus. Moreover, since these recording medium detectors cannot trace vertical and horizontal curling and deflection of recording media, they cannot consistently perform proper detection. Other concerns include scratches on recording media and operation noise of the apparatus when the recording medium detector comes into contact with the media.

SUMMARY OF THE INVENTION

The present invention is made in view of the technical problems described above. The present invention aims to provide, without requiring special apparatuses, an easy-to-use image forming apparatus that can easily and accurately read information on recording media and that can automatically determine the recording mode based on the type and properties of the recording media.

To achieve the object described above, an image forming apparatus according to a first aspect of the present invention includes a recording medium feeding unit for loading recording media thereon and feeding the media on a sheet-by-sheet basis, and an image forming unit for forming predetermined images on the recording media fed. The recording medium feeding unit further includes a recording medium determination device having a cam member operated by a power supply, a lever rotated by the cam member, an arm rotated by the lever, a spring for biasing the arm toward a recording medium loading unit, a holder assembly rotatably attached to the arm, a recording medium detector held by the holder assembly and reading information on the recording media, and a cam element provided between the cam member and the lever for gradually rotating the lever.

Thus, the present invention can provide, without requiring special apparatuses, an easy-to-use image forming apparatus that can easily and accurately read information on recording media and that can automatically determine the recording mode based on the type and properties of the recording media.

Further objects, features and advantages of the present invention will become apparent from the following description of the preferred embodiment (with reference to the attached drawings).

DESCRIPTION OF THE PREFERRED EMBODIMENTS

Figure 1:
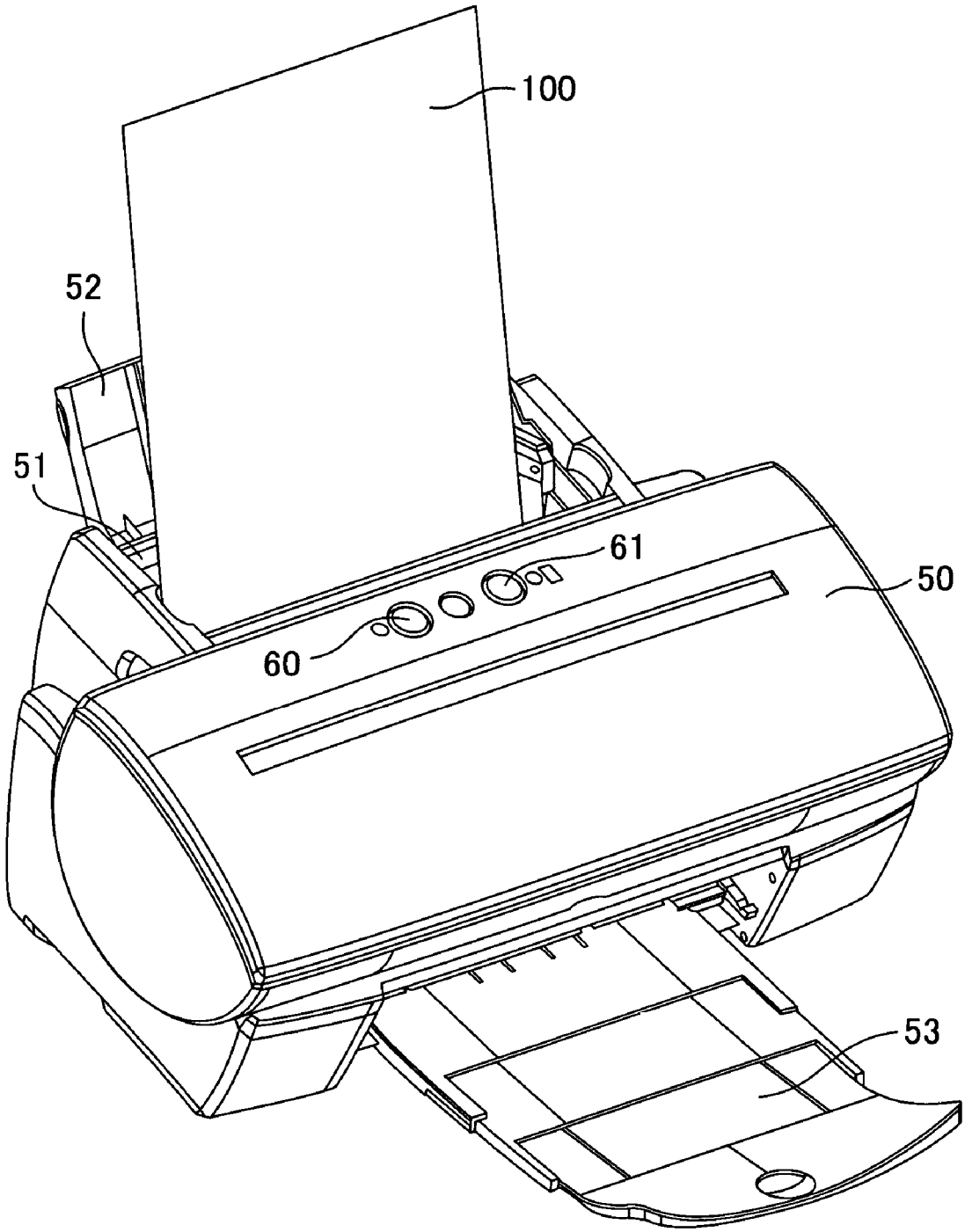
FIG. 1 is a schematic perspective view showing the overall structure of an image forming apparatus according to an embodiment of the present invention.

Embodiments of the present invention will now be described with reference to the drawings. In the drawings, the same or corresponding parts will be identified by the same reference numerals. FIG. 1 is a schematic perspective view showing the overall structure of an image forming apparatus according to an embodiment of the present invention. In FIG. 1, a recording medium 100 is, for example, recording paper, a paper feed tray 52 holds recording media, a recording medium feeding unit 51 feeds recording media to a recording section (printing section) on a sheet-by-sheet basis, an outer cover 50 covers an image forming unit (recording unit, recording head) and a recording medium carrying unit for carrying recording media, and an output tray 53 holds recording media with images recorded thereon. In addition, a power button 60 turns the image forming apparatus ON and OFF, and a resume button (restart button) 61 restores normal operation to the image forming apparatus when the apparatus malfunctions due to, for example, operational errors.

The image forming apparatus of the present embodiment is an inkjet image forming apparatus in which an inkjet image forming unit serves as an image forming unit (recording unit) and forms (records) images by ejecting ink through nozzles onto recording media based on image signals. Moreover, the image forming unit is a inkjet image forming unit ejecting ink by thermal energy and has an electric thermal converter for generating thermal energy. In the image forming unit, thermal energy applied by the thermal converter produces film boiling in the ink, which then brings about state changes (for example, pressure changes) caused by expansion and contraction of bubbles, and allows the ink to be ejected from the nozzles to form (record) images.

In FIG. 1, an operator loads a certain amount of the recording media 100 on the recording medium feeding unit 51, operates a host computer (not shown) communicably connected to the image forming apparatus to send image information thereto by driving software for the image forming apparatus. The image forming apparatus sends operation instructions to the recording medium feeding unit 51 according to recording instructions from the driving software. The recording media 100 are then fed into the image forming unit (recording unit), which is controlled based on the received image information and thus outputs recording media with images formed (recorded) thereon.

Figure 2:
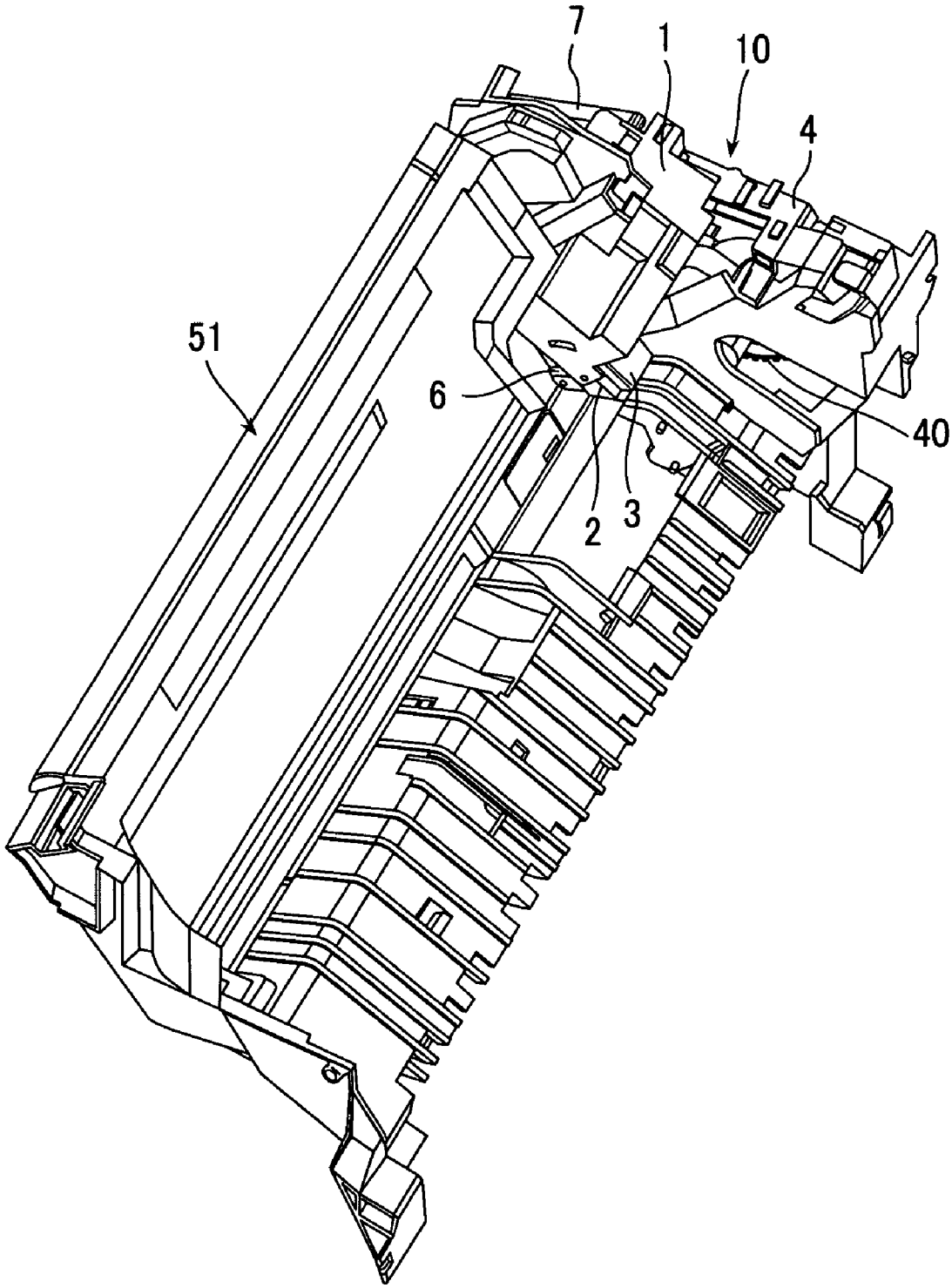
FIG. 2 is a schematic perspective view showing a recording medium feeding unit and a recording medium determination device mounted thereon that are included in the image forming apparatus according to the embodiment of the present invention.
Figure 3:
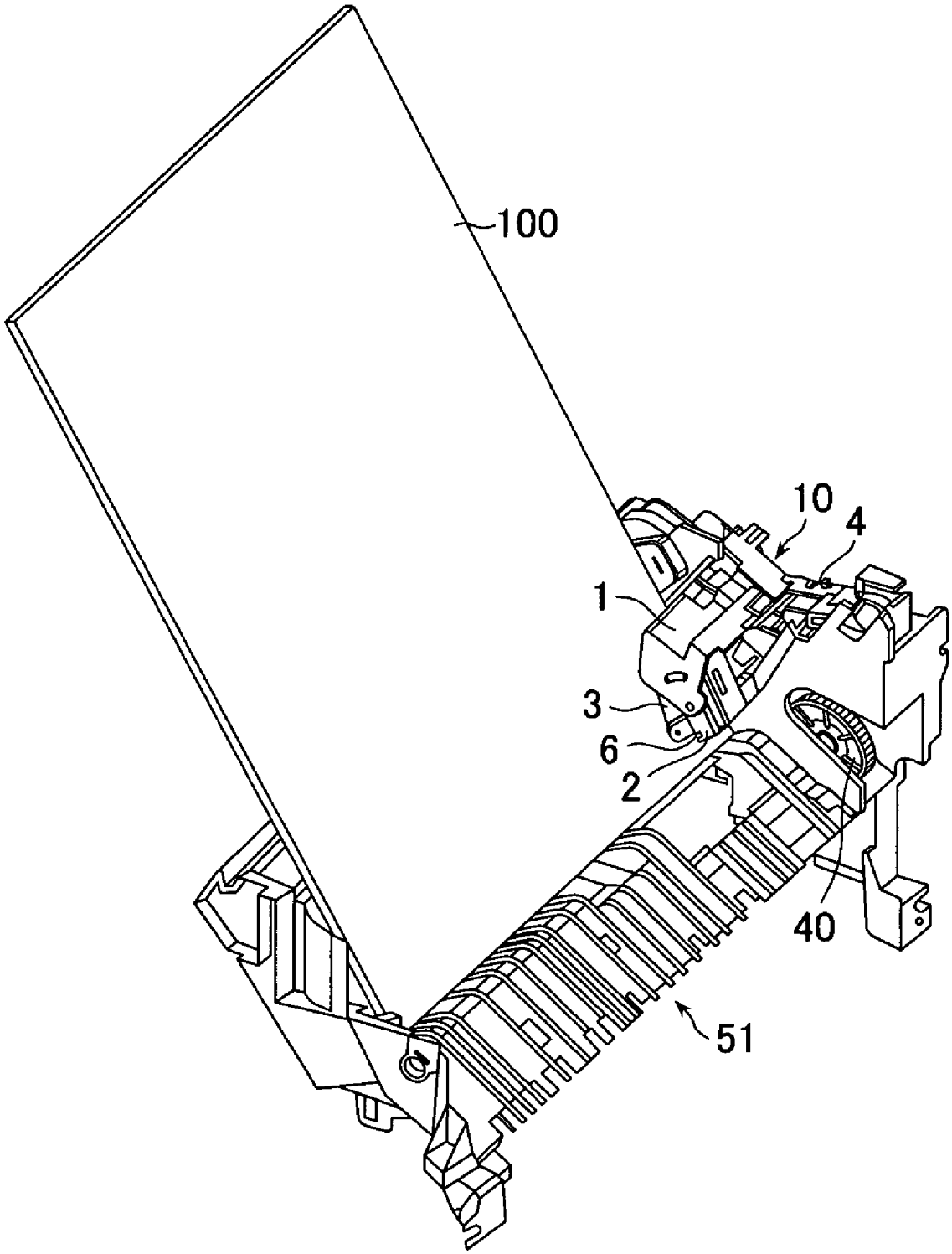
FIG. 3 is a schematic perspective view showing the recording medium feeding unit and the recording medium determination device of the image forming apparatus according to the present invention. Here, recording media are loaded and the image forming apparatus is in standby mode.
Figure 4:
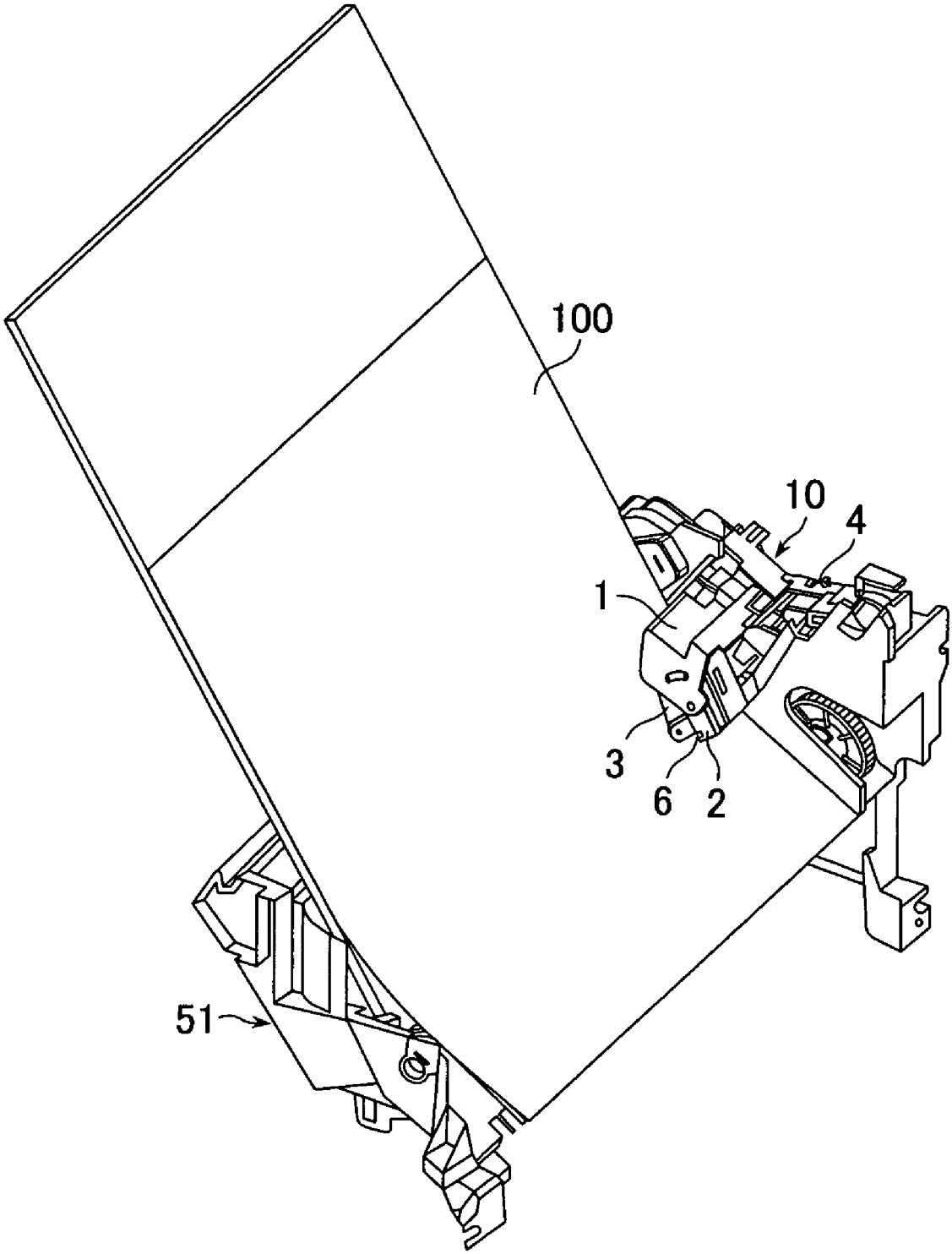
FIG. 4 is a schematic perspective view showing the recording medium feeding unit and the recording medium determination device in FIG. 3. Here, the image forming apparatus is in operation mode in which recording media are being fed.
Figure 5:
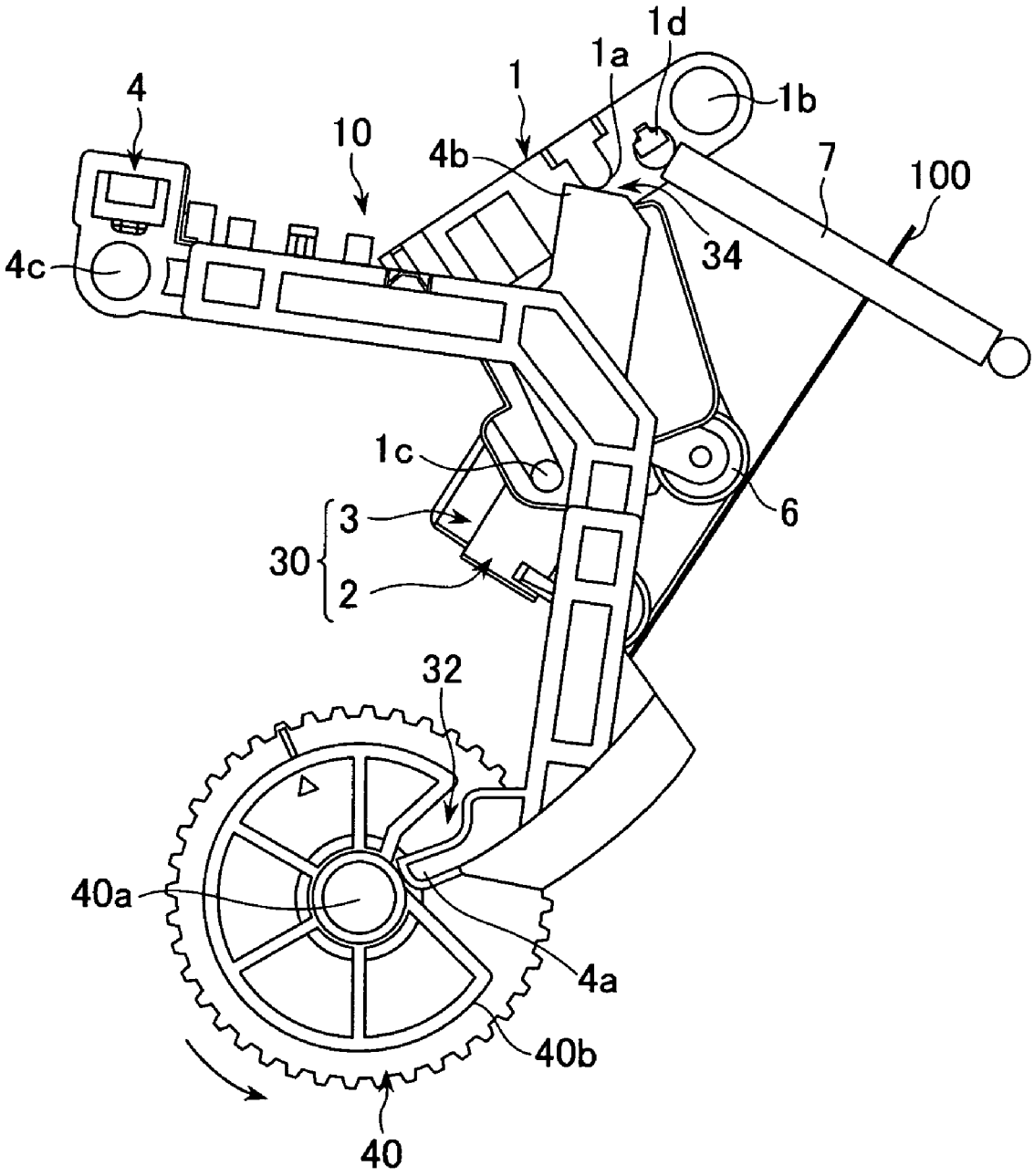
FIG. 5 is a schematic side view showing a state of a recording medium determination device of the image forming apparatus according to the embodiment of the present invention when the image forming apparatus is in standby mode.
Figure 6:
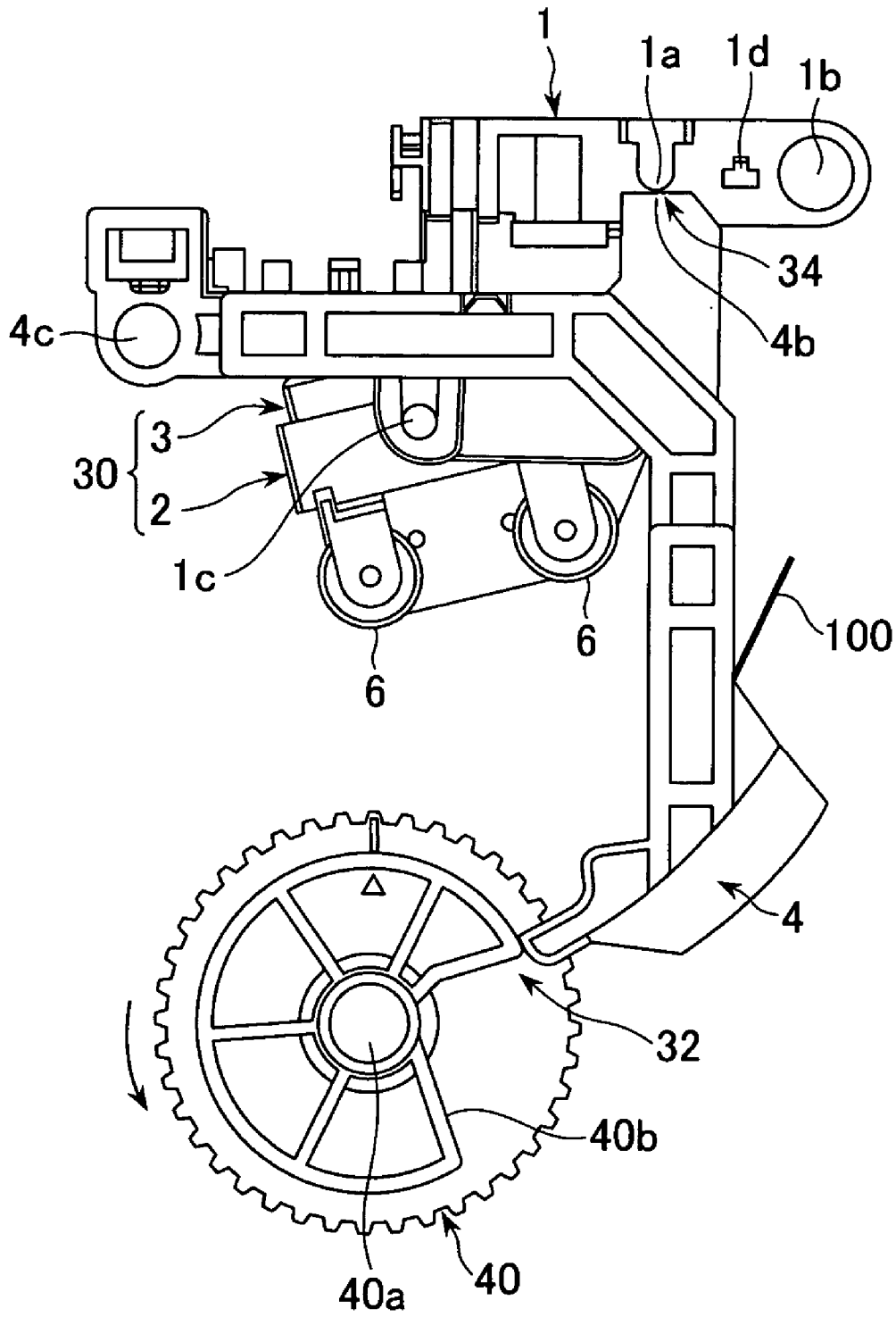
FIG. 6 is a schematic side view showing a state of the recording medium determination device in FIG. 5 when the image forming apparatus is in operation mode in which images are being formed.

FIG. 2 is a schematic perspective view showing the recording medium feeding unit and a recording medium determination device mounted thereon that are included in the image forming apparatus according to the embodiment of the present invention. FIG. 3 is a schematic perspective view showing a state of the recording medium feeding unit and the recording medium determination device in FIG. 2 when recording media are loaded and the image forming apparatus is in standby mode (in the initial state, or non-operating state). FIG. 4 is a schematic perspective view showing a state of the recording medium feeding unit and the recording medium determination device in FIG. 3 when the image forming apparatus is in operation mode (when recording media are being fed). FIG. 5 is a schematic side view showing a state of the recording medium determination device in FIG. 2 when the image forming apparatus is in standby mode. FIG. 6 is a schematic side view showing a state of the recording medium determination device in FIG. 5 when the image forming apparatus is in operation mode (when images are being formed). As shown in FIGS. 2 to 4, the recording medium feeding unit 51 has a recording medium determination device 10 for identifying the type and properties of the recording media 100 by reading information on the media.

Figure 13:
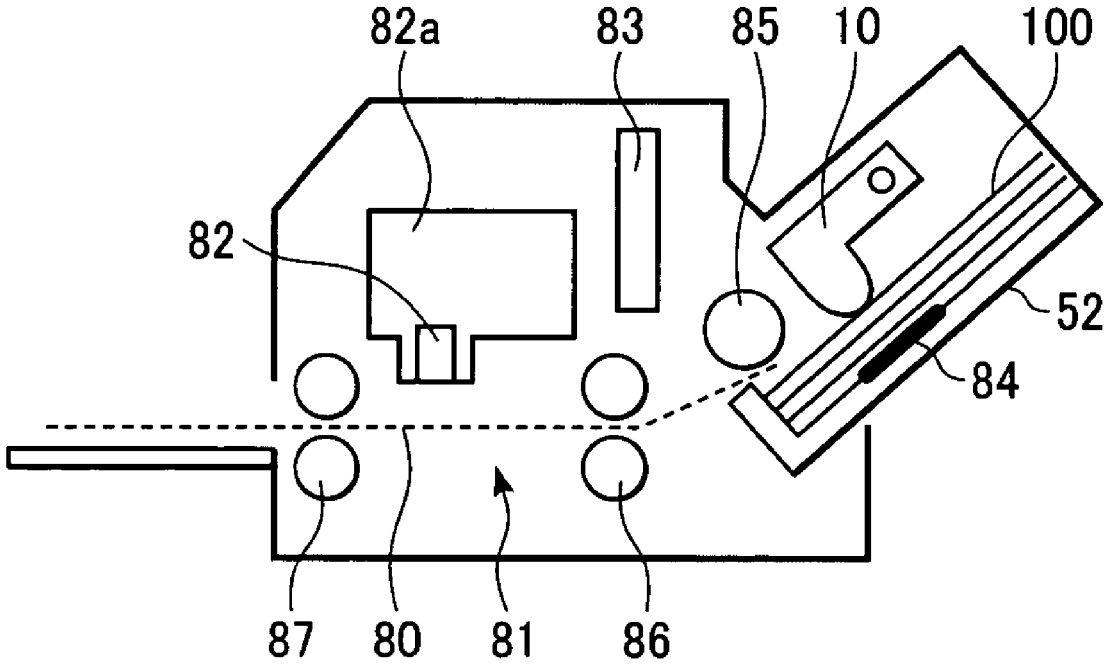
FIG. 13 is a schematic cross-sectional view showing the structure of the image forming apparatus according to the present invention.

FIG. 13 is a cross-sectional view showing the overall structure of the image forming apparatus.

In FIG. 13, the recording medium determination device (recording medium detecting means) 10 identifies the type of recording media. As shown, the recording medium determination device 10 is disposed in a recording medium loading unit (loading means) 52 so as to be in contact with the recording surface of the recording medium 100 loaded on the recording medium loading unit 52. A feeding path 80 conveys recording media during the recording operation.

An image forming section 81 is an area where images are formed on recording media. An image forming unit (image forming means) 82 is a recording head ejecting ink onto recording media for recording images. A carriage 82*a* has the recording head 82 and reciprocates the recording head 82 in the scanning direction (in the direction orthogonal to the surface of the drawing).

A circuit board 83 serves as a control unit (control means) for operating the image forming apparatus. An out-of-paper detecting chip 84 is used for detecting the presence or absence of recording media.

A pickup roller (feeding means) 85 included in the recording medium feeding unit serves as a feeding unit for feeding recording media 100 loaded on the recording medium loading unit 52, on a sheet-by-sheet basis, to the image forming unit 82.

An LF roller 86 is included in the image forming section 81 and serves as a carrying unit for carrying recording media in the direction orthogonal to the scanning direction of the recording head 82. An ejection roller 87 ejects recording media from the image forming apparatus.

In FIGS. 2 to 6, the recording medium determination device 10 includes a cam member (cam gear) 40 moved (rotated) by a power supply (drive source) (not shown); a lever 4 supported rotatably on a rotation shaft 40*a* provided in the recording medium feeding unit 51, the lever 4 being gradually rotated (rocked) by a cam element 32 provided between the cam member 40 and the lever 4; an arm 1 supported rotatably on a rotation shaft 1*b* provided in the recording medium feeding unit 51, the arm 1 being rotated (rocked) by a cam element 34 provided between the lever 4 and the arm 1; a spring 7 biasing the arm 1 toward the recording medium loading unit of the recording medium feeding unit 51 (or toward recording media on the loading unit); a holder assembly (holder member) 30 included in a recording medium detecting unit (recording medium detecting means) and rotatably attached to the arm 1 serving as a supporting member (supporting means); and a recording medium detector 70 (FIG. 7) also included in the recording medium detecting unit, held by the holder member, and reading information on the recording medium 100.

As shown in FIGS. 5 and 6, the holder assembly 30 includes a first holder segment 2 attached to the arm 1 rotatably on a rotation shaft 1*c* parallel to the rotation shaft 1*b* of the arm 1, and a second holder segment 3 attached to the first holder segment 2 rotatably on a shaft orthogonal to the rotation shaft 1*c* of the first holder segment 2. The recording medium detector 70 (FIG. 7) reading the information on the recording medium 100 is held in the second holder segment 3. This information includes various kinds of information required to identify the type and properties of the recording medium for image formation, and can be selected as necessary.

As shown in FIGS. 5 and 6, the cam element 32 provided between the cam member 40 and the lever 4 constitutes a transporting unit (moving means) for gradually rotating (rocking) the lever 4, and includes a cam surface 40*b* formed on the cam member 40 and a cam surface 4*a* formed on the lever 4. In the example shown in the drawings, the cam element 32 has a cam shape formed in the cam member 40 and sliding on a part of the lever 4. The cam element 34 provided between the lever 4 and the arm 1 includes a cam surface 4*b* formed on the lever 4 and a protrusion 1*a* provided in the arm 1.

The cam element 32 provided between the cam member 40 and the lever 4 may have a cam shape formed on the cam member 40 and sliding on a part of the lever 4. The cam element 32 may have a cam shape formed on the lever 4 and sliding on a part of the cam member 40. Alternatively, the cam element 32 may have a cam shape formed on both the cam member 40 and the lever 4 and sliding on each other. Any other structures that gradually rotate the lever 4 are also acceptable. As for the cam element 34, similarly to the cam element 32, any structures serving predetermined functions are acceptable.

In addition, a plurality of rotating members 6 (in the example shown in the drawings, four rotating members 6 located at respective corners of a square) that can be in contact with the recording medium loading unit or the recording medium 100 thereon, in standby mode shown in FIG. 5, are rotatably supported by the second holder segment 3 of the holder assembly 30. In standby mode, shown in FIG. 5, these rotating members 6 are in contact with the recording medium loading unit (or the recording medium 100) with a predetermined level of contact pressure created by a biasing force of the spring 7. On the other hand, during image formation, shown in FIG. 6, the arm 1 is forced to be rotated against the spring 7 and separated from the recording medium loading unit. In the state shown in FIG. 5, the recording medium detector 70 held in the holder assembly 30 obtains the information (type and properties) on the recording medium 100.

Figure 7A:
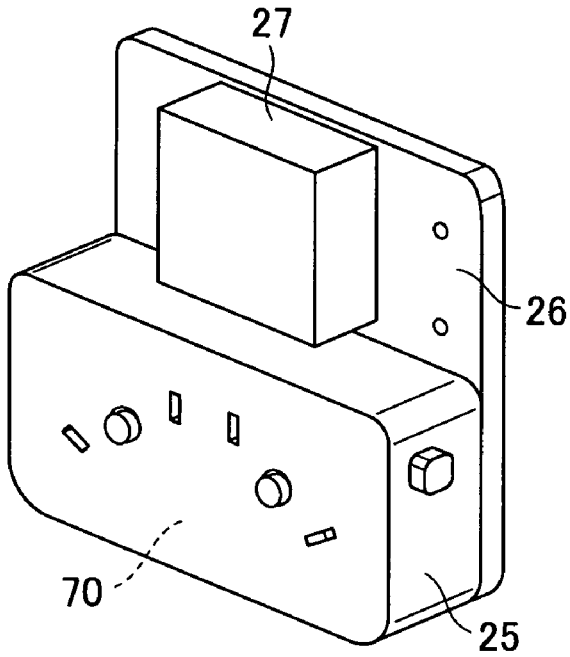
FIG. 7A is a schematic perspective view showing a recording medium detector of the recording medium determination device in FIG. 5.
Figure 7B:
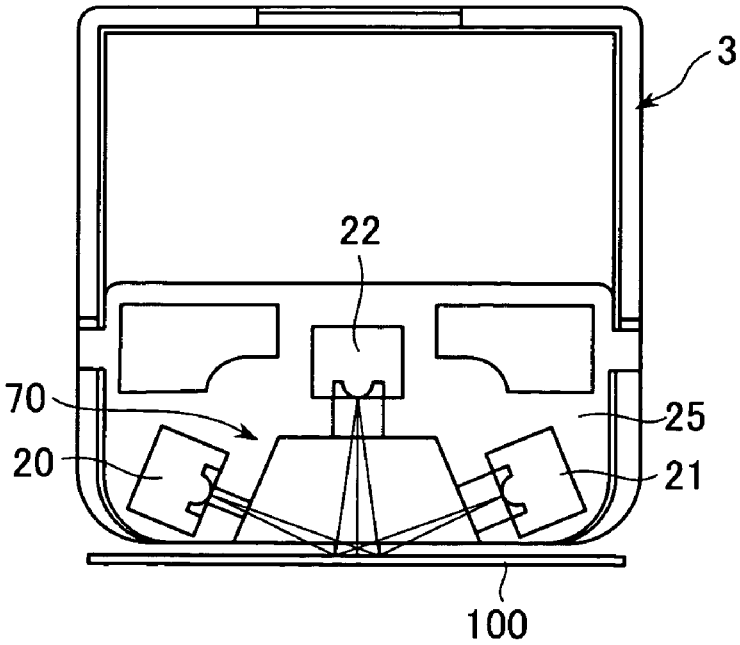
FIG. 7B is a schematic vertical cross-sectional view showing the recording medium detector held by a second holder segment.

FIG. 7A is a schematic perspective view showing the recording medium detector 70 of the recording medium determination device 10. FIG. 7B is a schematic cross-sectional view showing the recording medium detector 70 held in the second holder segment 3. As shown in FIG. 7B, the recording medium detector 70 is provided in a housing 25 held (mounted) in the second holder segment 3 of the holder assembly 30. The recording medium detector 70 is provided with a light-emitting element 20, light-sensitive elements 21 and 22, and an electric board (circuit board) 26 for connecting the light-emitting element 20 and the light-sensitive elements 21 and 22 to the outside. The housing 25 holding the recording medium detector 70 provided with the light-emitting element 20, the light-sensitive elements 21 and 22, and the electric board 26 is positioned in and supported by the second holder segment 3.

A connector 27 is attached to the electric board 26. The recording medium detector 70 having the light-emitting element 20 and the light-sensitive elements 21 and 22 is connected to an external control circuit via the connector 27 and wiring (not shown). The wiring may be directly connected to the electric board 26 such that the recording medium detector 70 communicates with the outside without using the connector 27. FIG. 7B shows a state when information on the recording medium 100 is being detected. This corresponds to FIG. 5 showing a state of the recording medium determination device 10 when the image forming apparatus is in standby mode. In the present embodiment, the recording medium detector 70 is provided with the light-emitting element 20 emitting light of wavelengths in the infrared region toward the recording medium 100, the light-sensitive element 21 receiving specular reflection light from the recording medium 100, and the light-sensitive element 22 receiving diffuse reflection light from the recording medium 100.

Figure 8A:
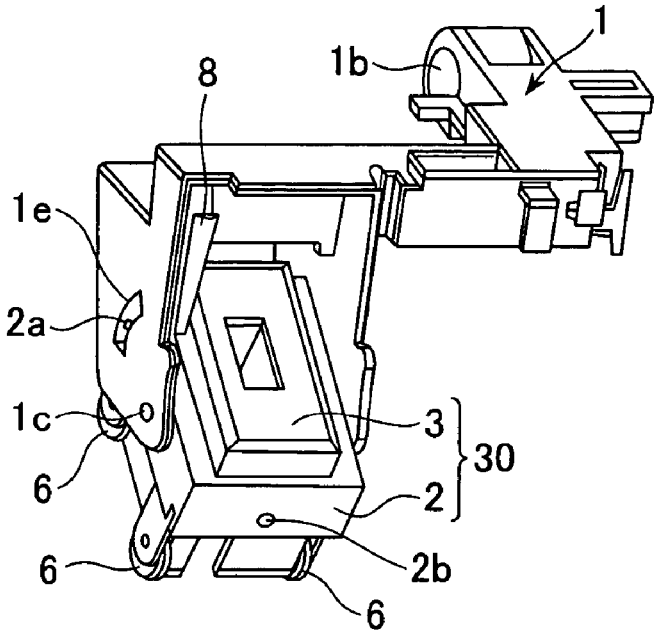
FIG. 8A and FIG. 8B are a schematic perspective view and a schematic side view, respectively, showing supporting mechanisms of a holder assembly holding the recording medium detector of the recording medium detecting device in FIG. 5.
Figure 8B:
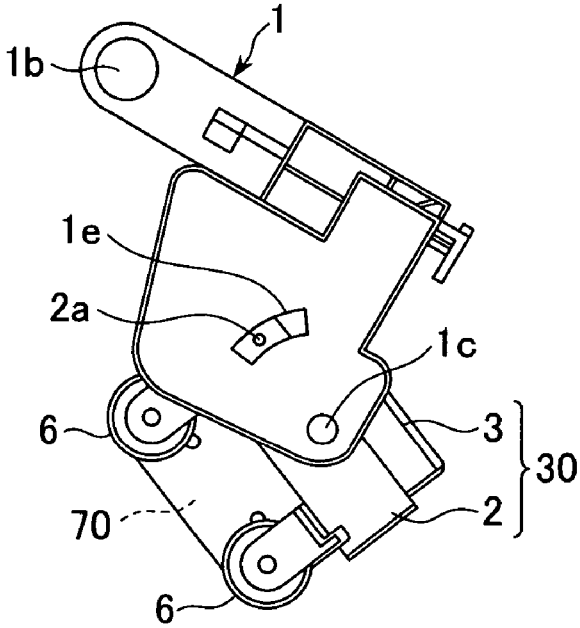

FIG. 8A and FIG. 8B are a schematic perspective view and a schematic side view, respectively, showing supporting mechanisms of the holder assembly 30 holding the recording medium detector 70 of the recording medium determination device 10. As shown in FIGS. 8A and 8B, the first holder segment 2 of the holder assembly 30 is attached to the arm 1 rotatably (rockingly) on the rotation shaft 1*c* parallel to the rotation shaft 1*b* of the arm 1. A spring 8 is provided between the first holder segment 2 and the arm 1. The second holder segment 3 is attached to the first holder segment 2 rotatably (rockingly) on a rotation shaft 2*b* orthogonal to the rotation shaft 1*b* of the first holder segment 2. The spring 8 improves contact between the recording medium determination device 10 (in the present embodiment, the rotating members 6 rotatably supported by the second holder segment 3) and the recording medium 100. That is, for example, the recording medium determination device 10 uniformly and smoothly comes into contact with the recording medium 100 with a predetermined pressure without shocks.

In the holder assembly 30 of the present embodiment, the second holder segment 3 and the first holder segment 2 are rotatable (rockable) within a certain range with respect to the arm 1. This is to compensate for distortion of the recording medium 100 (for example, rippling of the recording medium 100) in the direction orthogonal to the feeding direction, and parallelism error of the recording medium determination device 10 with respect to the recording medium loading surface (recording medium 100 thereon) of the recording medium feeding unit 51. Moreover, a protrusion 2*a* in the first holder segment 2 is engaged with a fan-shaped slot 1*e* in the arm 1 such that the moving range (rocking range) of the first holder segment 2 is limited. Thus, improvement of contact between the recording medium determination device 10 and the recording medium 100 can be achieved, and interference of the recording medium determination device 10 with other regions (including other parts) can be prevented.

Figure 9:
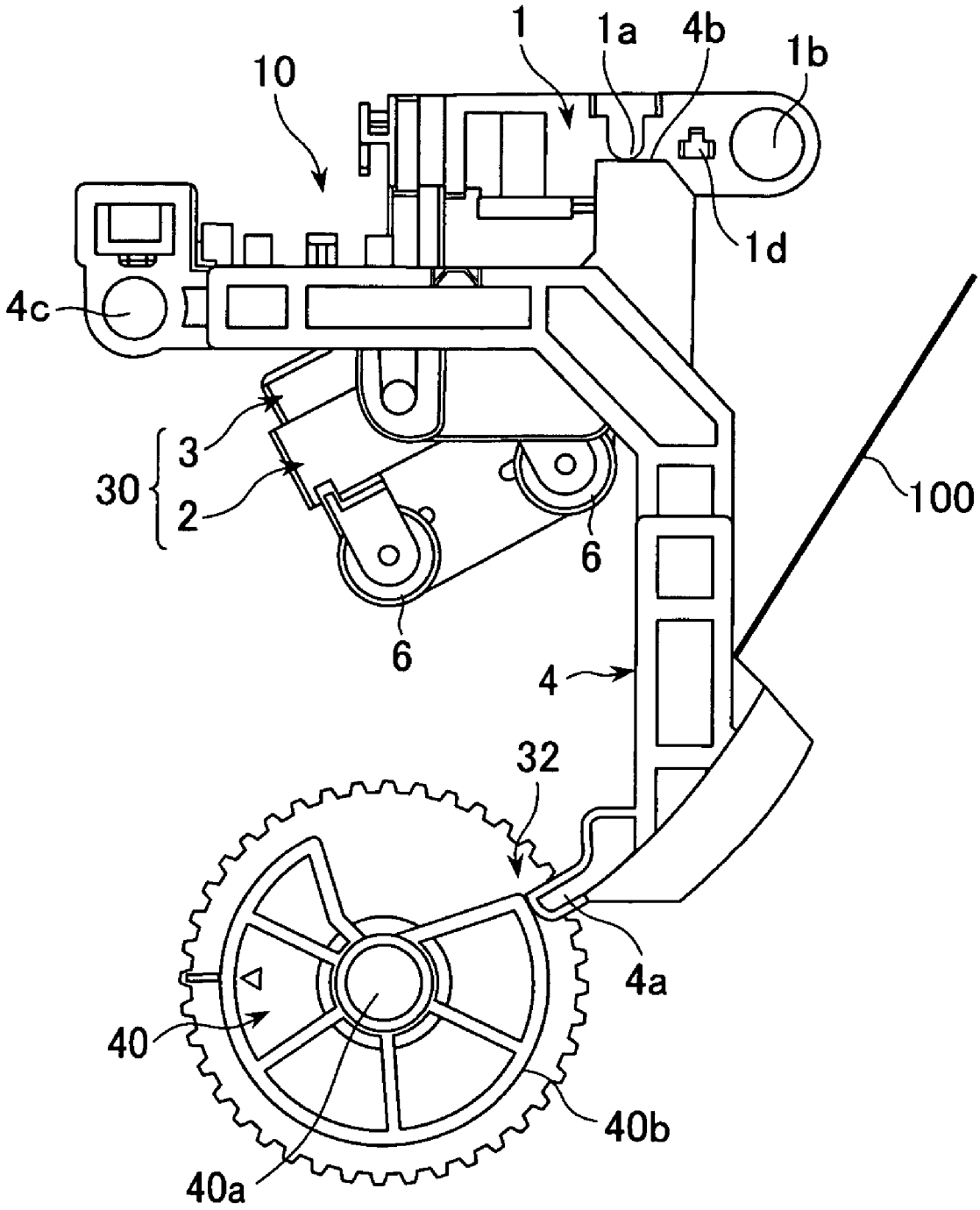
FIG. 9 is a schematic side view showing a state of the recording medium determination device of the image forming apparatus according to the embodiment of the present invention when recording media is being fed.
Figure 10:
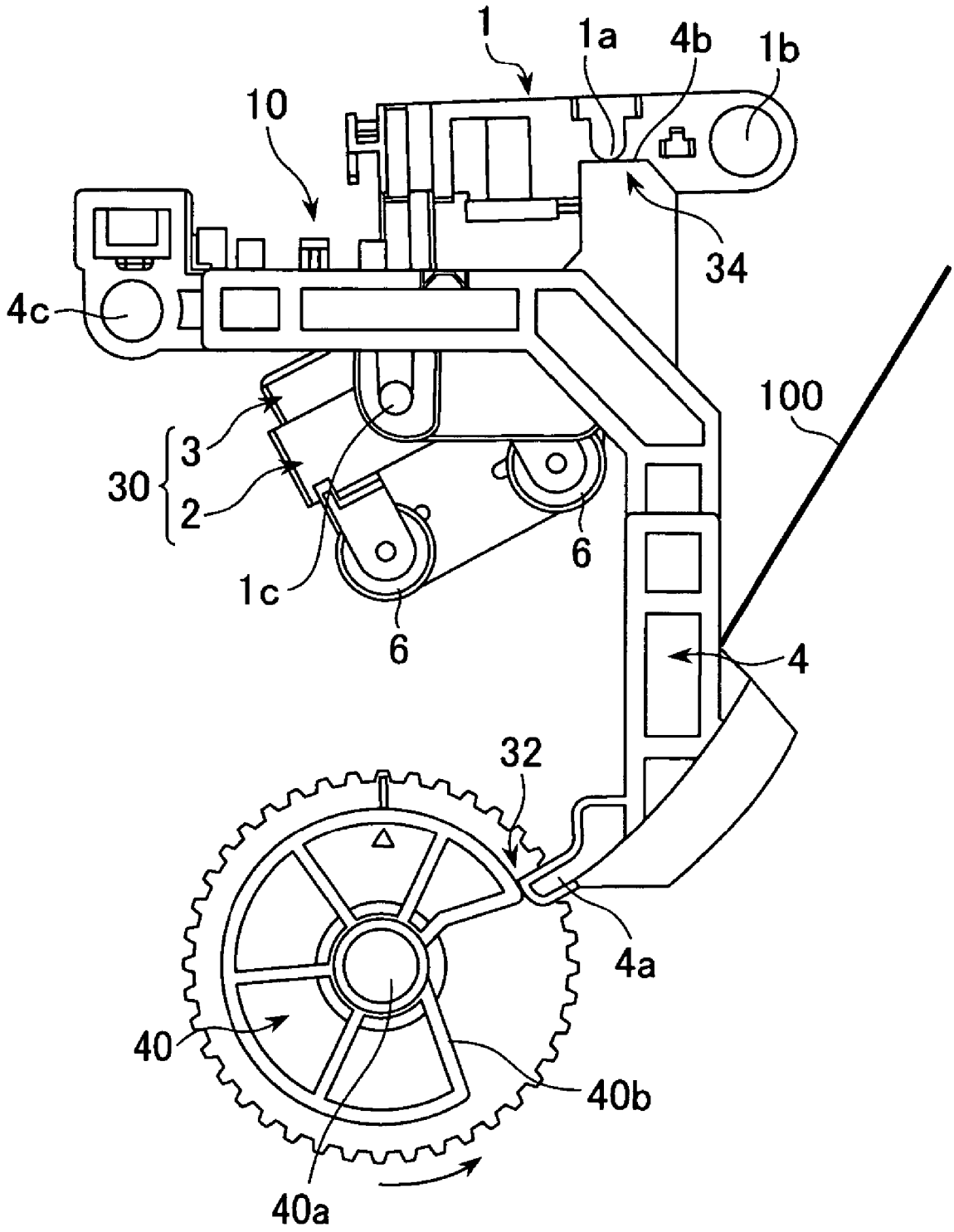
FIG. 10 is a schematic side view showing a state of the recording medium determination device in FIG. 9 during image formation.
Figure 11:
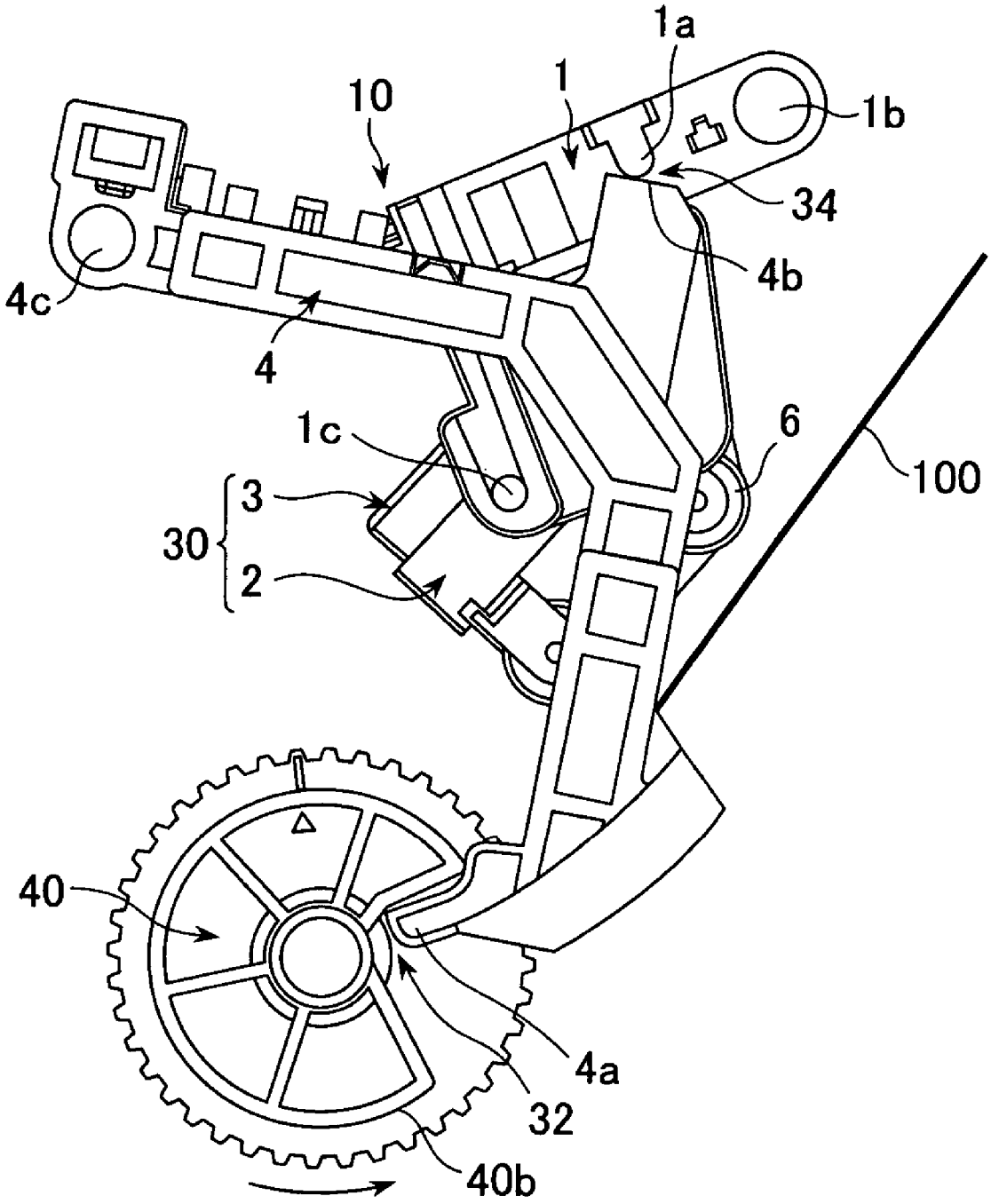
FIG. 11 is a schematic side view showing a state of the recording medium determination device in FIG. 9 after the completion of image formation.

FIG. 9 is a schematic side view showing a state of the recording medium determination device 10 in FIG. 4 when recording media is being fed. FIG. 10 is a schematic side view showing a state of the recording medium determination device 10 in FIG. 5 during image formation. FIG. 11 is a schematic side view showing a state of the recording medium determination device 10 in FIG. 5 after the completion of image formation. The operation of the recording medium feeding unit 51 and the recording medium determination device 10 will now be described with reference to these drawings. When the image forming apparatus is in standby mode, as shown in FIG. 5, the recording medium determination device 10 is in contact with the recording medium 100 (the rotating members 6 are in contact with a surface of the recording medium 100). When a recording instruction is received from the image forming apparatus, the cam member 40 is rotated counterclockwise (leftward) (in the drawing) on the rotation shaft 40*a* by power from a drive source (not shown).

The cam surface 40*b* of the cam member 40 is in contact with the cam surface 4*a* of the lever 4 rotatable on a rotation shaft 4*c*. Since the cam surface 4*a* moves along the cam surface 40*b* as the cam member 40 rotates, the lever 4 rotates on the rotation shaft 4*c* to bring the recording medium determination device 10 into the state shown in FIG. 9, in which recording media is being fed. Moreover, since the cam surface 4*b* of the lever 4 is in contact with the protrusion 1*a* of the arm 1, the arm 1 rotates clockwise (in the drawing) on the rotation shaft 1*b* as the lever 4 rotates. This clockwise rotation of the arm 1 allows the first holder segment 2 and the second holder segment 3 mounted on the arm 1 to separate from the recording medium 100 loaded on the recording medium feeding unit 51, thereby allowing the recording medium determination device 10 to separate from the recording medium 100, as shown in FIG. 9. Subsequently, the recording medium 100 loaded on the recording medium feeding unit 51 is fed to an image forming section (recording section in which the image forming unit is provided).

The recording medium determination device 10 is brought into the state shown in FIG. 10 when the image forming unit records (forms) images on the recording medium 100 fed to the image forming section (recording section). In the image formation process shown in FIG. 10, the recording medium determination device 10 is separated from the loaded recording medium 100, similarly to that in the recording medium feeding process shown in FIG. 9. That is, the recording medium determination device 10 is separated from the recording medium 100 so as not to affect the image formation.

After the completion of image formation, the cam member 40 is rotated counterclockwise (leftward) (in the drawing) to bring the recording medium determination device 10 into the state shown in FIG. 11. Then, further leftward rotation of the cam member 40 returns the recording medium determination device 10 to the initial state (standby state) shown in FIG. 5. Since, in this process, the cam surface 4*a* of the lever 4 moves along the cam surface 40*b* of the cam member 40, the lever 4 and the arm 1 are gradually rotated as shown in FIGS. 10, 11, and 5, in this order. Although, in the state shown in FIG. 11, the recording medium determination device 10 (its rotating members 6) is not yet in contact with the recording medium 100, subsequent counterclockwise (leftward) (in the drawing) rotation of the cam member 40 gradually brings the recording medium determination device 10 (its rotating member 6) into contact with the recording medium 100. This not only prevents the recording medium determination device 10 from scratching the recording medium 100, but also reduces the noise caused by contact between the recording medium determination device 10 and the recording medium 100.

Figure 12:
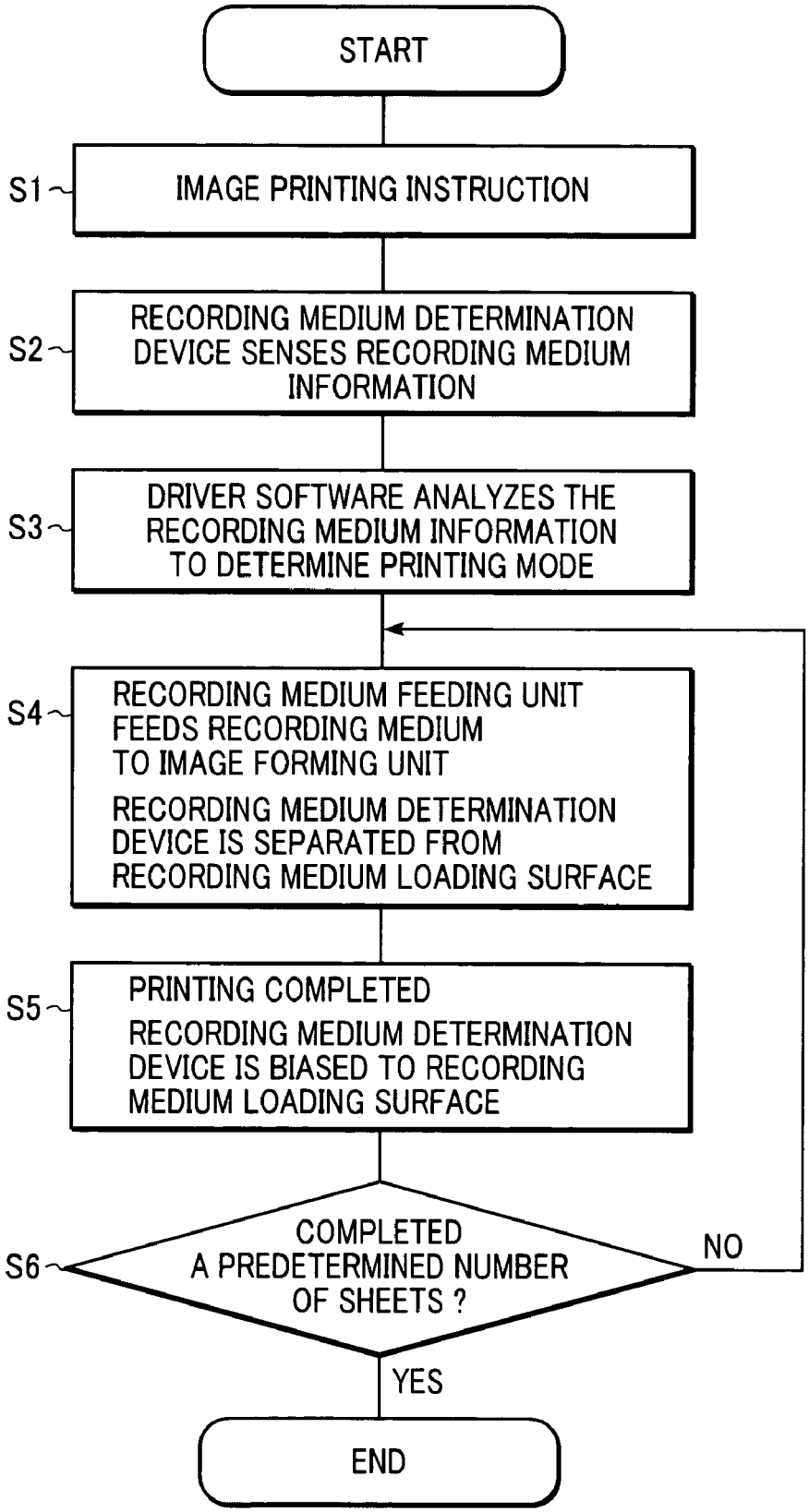
FIG. 12 is a flowchart showing the operation sequence of the recording medium determination device of the image forming apparatus according to the present invention.

FIG. 12 is a flowchart showing the operation sequence of the recording medium determination device of the image forming apparatus according to the present invention. A process for detecting recording media by the recording medium determination device 10 will now be described with reference to FIGS. 12, 3, and 4. Referring to FIGS. 12 and 3, in step S1, instructions for image formation (image printing instructions) are sent from an application software to a driver software for the image forming apparatus. Subsequently, the driver software sends instructions for sensing recording media information to the image forming apparatus. In step S2, the image forming apparatus activates the recording medium determination device 10 to sense the information (type and properties) on the recording medium 100 loaded on the recording medium loading unit (such as the paper feed tray 52) of the recording medium feeding unit 51.

In this step, as shown in FIG. 7B, the light-emitting element (for example, a light emitting diode (LED)) 20 emits light to the recording medium 100, while the light-sensitive elements 21 and 22 receive specular reflection light and diffuse reflection light from the recording medium 100. The information received is converted by an analog-to-digital (A/D) converter to numerical information and sent back to the driver software. In step S3, the driver software analyzes the numerical information to determine the most suitable recording mode (printing mode). Subsequently, instructions for feeding recording media are sent from the image forming apparatus to the recording medium feeding unit 51. In step S4, the recording medium feeding unit 51 feeds a sheet of recording medium 100 to the image forming unit (recording unit). Here, as shown in FIG. 4, the recording medium determination device 10 is separated from the surface for loading recording media so as not to affect feeding of recording media by the recording medium feeding unit 51 and image formation by the image forming unit (step S4).

In step S5, after the completion of image formation (image printing), the recording medium determination device 10 is biased to come into contact with the surface of the recording medium loading unit (normally, the surface of the loaded recording media). When images are to be formed on a plurality of sheets of recording media, a determination is made, in step S6, as to whether images have been formed on a predetermined number of sheets. For further image formation, back in step S4, the recording medium feeding unit 51 feeds another sheet of recording media to the image forming unit to repeat the operation a predetermined number of times to complete a series of image forming steps (image printing).

While, as shown in FIG. 4, the recording medium determination device 10 is separated from the surface of the recording medium loading unit (recording medium 100 thereon) in recording medium feeding mode and image formation mode, the recording medium determination device 10 is in contact with the surface of the recording medium loading unit or the recording medium 100 thereon, as shown in FIG. 3, in normal non-operating mode (in the standby state and initial state). When another instruction for forming images is sent from a host computer in the state shown in FIG. 3, a series of operations described in the flowchart in FIG. 12 is executed.

The present invention is not limited to the above-described structure of the embodiment, but may include various modifications based on the same technical idea. For example, the cam surface 40*b* of the cam member 40 may have a step-like shape such that the lever 4 can be gradually rotated when the recording medium determination device 10 is in contact with the recording medium 100. Furthermore, the cam element 32 between the cam member 40 and lever 4, and the cam element 34 between the lever 4 and the arm 1 may have any structures that allow them to function as the intended cam elements described above.

Although the inkjet-type recording apparatus using liquid ink has been described in the above embodiment, the present invention may also be applied to other types of recording apparatuses using ink ribbons and the like, such as wire-dot type, thermal type, and laser-beam type recording apparatuses, and achieves similar effects. In addition, the present invention may also be applied, for example, to a recording apparatus for monochrome recording, a color recording apparatus for recording in a plurality of different colors with one or more recording heads, a gradation recording apparatus for recording in a single color with a plurality of different tones, and a combination of these recording apparatuses, and can achieve similar effects.

When the present invention is applied to inkjet recording apparatuses using liquid ink for recording, it may be applied to those incorporating a replaceable head cartridge in which a recording head and an ink tank are integrated. Moreover, the present invention may be applied to an inkjet recording apparatus incorporating a recording unit using an electromechanical transducer, such as a piezoelectric element. When applied to an inkjet recording apparatus incorporating a recording unit using thermal energy for ejecting ink, the present invention is particularly effective in that it can achieve high-density and high-definition recording.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An image forming apparatus comprising:

recording medium feeding means for loading recording media thereon and feeding the recording media on a sheet-by-sheet basis, the recording medium feeding means comprising a recording medium determination device including a cam member operated by a power supply;

a lever rotated by the cam member;

an arm rotated by the lever;

a spring for biasing the arm toward recording medium loading means;

a holder assembly rotatably attached to the arm;

a recording medium detector held by the holder assembly and reading information on the recording media; and a cam element provided between the cam member and the lever for gradually rotating the lever; and image forming means for forming predetermined images on the recording media fed.

2. The image forming apparatus according to claim 1, the holder assembly further comprising:

a first holder segment attached to the arm rotatably on a rotation shaft parallel to a rotation shaft of the arm; and a second holder segment attached to the first holder segment rotatably on a rotation shaft orthogonal to the rotation shaft of the first holder segment, wherein the recording medium detector is held by the second holder segment.

3. The image forming apparatus according to claim 1 or 2, wherein the cam element has a cam shape formed in the cam member and sliding on a part of the lever.

4. The image forming apparatus according to claim 1 or 2, wherein the cam element has a cam shape formed in the lever and sliding on a part of the cam member.

5. The image forming apparatus according to claim 1 or 2, wherein the cam element has a cam shape formed in both the cam member and the lever and sliding on each other.

6. The image forming apparatus according to claim 1 or 2, wherein the image forming means is inkjet image forming means that forms images by ejecting ink through nozzles onto the recording media.

7. The image forming apparatus according to claim 1 or 2, the recording medium detector of the recording medium determination device further comprising:

a light-emitting element emitting light of wavelengths in the infrared region toward the recording media; and light-sensitive elements, one receiving specular reflection light from the recording media, the other receiving diffuse reflection light from the recording media.

8. An image forming apparatus comprising:

loading means for loading recording media thereon;

recording medium detecting means being in contact with the recording media loaded on the loading means and reading information on the recording media;

supporting means for supporting the recording medium detecting means movably from a position where the recording medium detecting means contacts with the recording media loaded on the loading means;

moving means for moving the recording medium detecting means away from the position where the recording medium detecting means contacts with the recording media;

feeding means for feeding the recording media from the loading means; image forming means for forming images on the recording media fed by the feeding means; and control means controlling the recording medium detecting means to read information on the recording media according to image formation instructions, then controlling the moving means to move the recording medium detecting means away from the recording media loaded on the loading means, and then controlling the feeding means to feed the recording media.

9. The image forming apparatus according to claim 8, wherein the recording medium detecting means, in standby mode, is in contact with the recording media loaded on the loading means.

10. The image forming apparatus according to claim 8, wherein the moving means brings the recording medium detecting means into contact with the loaded recording media after the completion of the image formation on the recording media by the image forming means.

11. The image forming apparatus according to claim 8, wherein the control means starts feeding by the feeding means after determining an image formation mode of the image forming means based on the information read by the recording medium detecting means.

12. The image forming apparatus according to claim 8, wherein the control means changes an image formation mode of the image forming means depending on the information on the recording media read by the recording medium detecting means.

13. The image forming apparatus according to claim 8, wherein the control means changes the amount of ink and the number of ink dots depending on the information on the recording media read by the recording medium detecting means.

14. The image forming apparatus according to claim 8, the recording medium detecting means comprising:

a recording medium detector for reading the information on recording media;

a holder member for holding the recording medium detector; and at least one rotating member rotatably provided in the holder member for making contact with recording media.

* * * * *